US005148683A

United States Patent [19]

Muller et al.

[11] Patent Number: 5,148,683

[45] Date of Patent: Sep. 22, 1992

[54] DEVICE FOR INTRODUCING COLD AIR INTO A ROOM

[75] Inventors: Gottfried Muller; Paul Hipp, both of Kolbingen, Fed. Rep. of Germany

[73] Assignee: SCHAKO Metallwarenfabrik Ferdinand Schad KG, Kolbingen, Fed. Rep. of Germany

[21] Appl. No.: 703,389

[22] Filed: May 21, 1991

[30] Foreign Application Priority Data

May 23, 1990 [DE] Fed. Rep. of Germany ..... 4016563

[51] Int. Cl.[5] ..... F25D 17/00

[52] U.S. Cl. ..... 62/180; 165/22; 454/299; 454/308

[58] Field of Search ..... 62/DIG. 16, 262, 238.6, 62/186, 185; 165/122, 53; 98/34.6, 40.17, 40.14, 40.05; 236/49.3; 454/299, 308

[56] References Cited

U.S. PATENT DOCUMENTS

| | | | |
|---|---|---|---|
| 2,251,649 | 8/1941 | Wichmann | 165/122 X |
| 2,270,665 | 1/1942 | Wheller | 165/122 X |
| 3,768,546 | 10/1973 | Shipes | 165/122 X |
| 3,877,243 | 4/1975 | Kramer | 62/186 X |
| 4,134,274 | 1/1979 | Johnsen | 62/238.6 X |
| 4,478,053 | 10/1984 | Yano et al. | 62/262 |

*Primary Examiner*—William E. Wayner
*Attorney, Agent, or Firm*—Bachman & LaPointe

[57] ABSTRACT

In an outlet, in particular for introducing cold air into a room, having a housing (1) made of side walls (2) and a room-side cover plate (3) with outlets (4), a refrigeration assembly (11) is to be inserted in the housing (1). The refrigeration assembly (11) comprises a covering (12) with a cylinder-like air inlet (20) and a cooling unit (13). The latter is assigned at least one fan, preferably however two fans (14, 15) inside the cylindrical air guide plate (20).

6 Claims, 2 Drawing Sheets

DEVICE FOR INTRODUCING COLD AIR INTO A ROOM

BACKGROUND OF THE INVENTION

The present invention relates to a device for introducing cold air into a room comprising a housing having side walls and a room-side cover plate with outlets.

Devices for introducing fresh air into rooms are known and are widespread. In most cases these are complete ventilation systems, ceiling or wall outlets having, on the one hand, a swirl outlet or the like and having, on the other hand, a connector nozzle, in particular to a tunnel box, for an air duct.

Such systems are suitable for introducing fresh air, in particular from outside, into rooms, specifically with the aid of fans or the like. In this case, the air is conducted over long routes and is hardly cooled during the process. This means that it is largely passed on just as it is taken in from outside.

If the temperature in a room is to be changed, in particular cooled, it is necessary to install a unit in a ventilation system, which unit provides an appropriate cooling. For such requirements, in most cases a complex air-conditioning plant is fitted or refrigeration units are installed which are operated using special refrigerants, in particular using environmentally damaging or not easily disposable refrigerants (CHC).

For smaller rooms, an air-conditioning plant means a great financial outlay and a great amount of work, which is often greatly disproportionate to the benefit achieved. A plant using special refrigerants should be avoided nowadays for reasons of environmental protection. Moreover, in both devices, in most cases extensive constructional modifications have t be undertaken.

Accordingly, it is the principle object of the invention to design a device which, on the one hand, does not require extensive constructional modifications for installation and can easily be mounted almost anywhere and which, on the other hand, does not constitute a hazard to the environment, even in respect of later disposal.

SUMMARY OF THE INVENTION

The foregoing object is achieved in a device of the type mentioned above wherein a refrigeration assembly is inserted in the housing.

In a device of this type, the refrigeration assembly comprises a round or approximately square covering which forms a shoulder towards the top. In this case, the shoulder forms an opening which is, in particular, round, and on top of which a cylindrical, chimney-shaped or funnel-shaped air inlet is placed. Towards the bottom, the covering forms angled-off edges, by means of which it rests on or is attached to a cover plate, assigned to the housing on the room side, with outlets.

A refrigeration unit is inserted, inside the covering. This refrigeration unit comprises pipes, in particular water pipes, which extend horizontally and vertically relative to one another and are connected to one another. Adjacent louvers are assigned to the pipes for better delivery of the cooling, said louvers preferably comprising approximately rectangular metallic, thin-wall plates. Corresponding bore holes in the louvers are penetrated by the pipes and are fixedly connected to the pipes by soldering or welding points, specifically in such a way that they form gaps, through which a corresponding air flow can pass.

The pipes of the cooling unit are preferably filled with tap water, for which purpose they have a connection to a tap water system.

Furthermore, according to the invention the pipes can be connected to a heat pump via a piping system.

When the air flows through the cooling unit, the air cools down because the tap water in the cooling unit usually has a temperature of about 8° C. In contrast, heat from the air is given off to the tap water. The thus slightly heated tap water flows via a return line to the heat pump, gives off the heat there via a heat exchanger and then flows, cooled down again, via an approach line to the cooling unit. During this process, on the one hand very little tap water is consumed and on the other hand the heat gained via the heat pump can be reused. It is conceivable for parts of the building facing away from the sun to be heated using this heat gained or for it to be used to heat service water.

The housing of the abovementioned outlet has side walls which preferably have circulating-air slots or in which circulating-air slots are punched or shaped. Arranged behind the circulating-air slots are louvers which are adjustable manually, mechanically or electronically, hydraulically, pneumatically or in a similar manner. They ensure that the outlet is provided with circulating air and that the best air flow is achieved in each case.

Installed adjacently inside the cylindrical, chimney-shaped or funnel-shaped air outlet are preferably two fans which can be switched individually and are arranged in such a way that one fan activates one half of the unit in each case.

If a high degree of cooling is required, both fans are in operation so that the entire cooling unit is surrounded by circulating air. By this means, a large amount of cold-temperature air is delivered to the room.

If less cooling is required, one fan switches off so that only one fan operates over half of the cooling unit. This is an enormous advantage, with the result that, also in the case of the small amount of air conduction, only about half of the cooling unit is activated, with the result that the outlet still functions satisfactorily even under minimum conduction of inlet air.

However, it is also conceivable for only one fan, which can, for example, be operated in several stages, to be installed inside the air inlet.

The device, in particular the fans, are controlled via a room thermostat so that an even room temperature can be maintained. This room thermostat may also be connected to the heat pump so that, if there is a stoppage of the fans, the circulation of the tap water also ceases.

In order to guarantee a very good and rapid and yet draft-free blending of the air in the room, the abovementioned cover plate has special slots which are arranged, in particular, radially, approximately in the shape of a star and to which, in turn, specially arranged louvers are assigned in the housing interior.

The great advantage of such an outlet with a refrigeration assembly is that, in this case, no additional energy is used for cooling units with the corresponding refrigerant, such as, for example, CHC. Particularly in the case of air-conditioning plants, the cooling is very energy-intensive and expensive. In this outlet, normal tap water can be used. In conjunction with the heat pump, this appliance is extremely energy-saving. A further advantage is the fact that the installation is extremely simple and can also be undertaken by virtually any plumber or heating technician.

BRIEF DESCRIPTION OF THE DRAWINGS

Further advantages, features and details of the invention emerge from the subsequent description of a preferred exemplary embodiment and from the drawing, in which.

DETAILED DESCRIPTION

Figure 1:
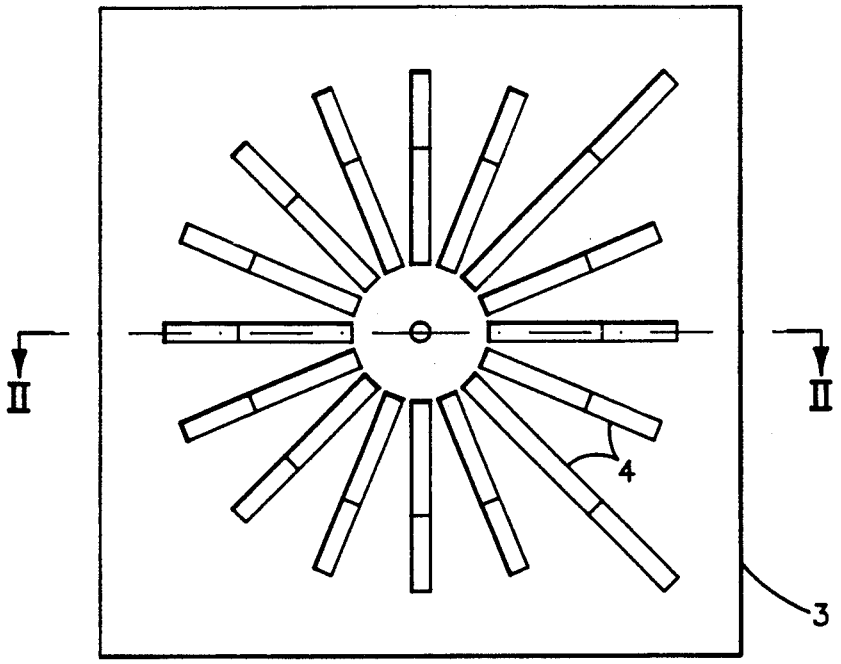
FIG. 1 shows a plan view of an underside of an outlet according to the invention.
Figure 2:
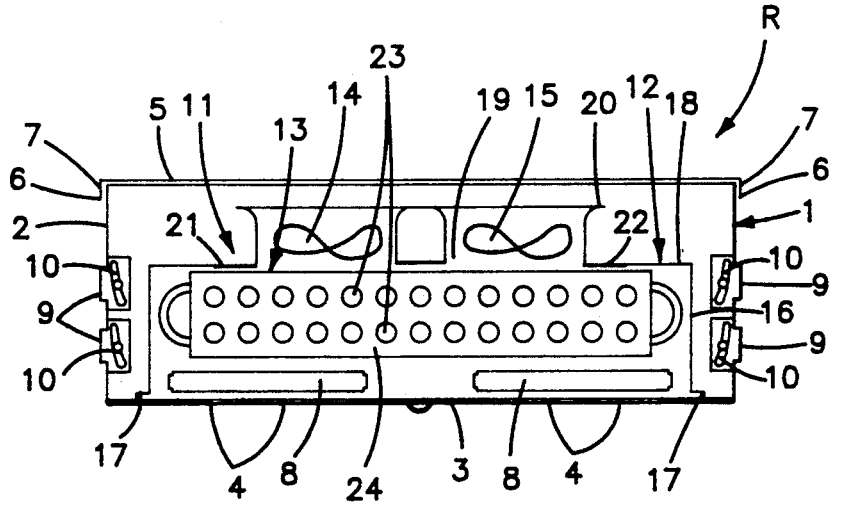
FIG. 2 shows a cross section through the outlet along a sectional line II—II according to FIG. 1.

The ventilation device R of the present invention comprises a housing 1 having side walls 2 and an approximately square cover plate 3. The cover plate is provided with slots 4 which, in the preferred exemplary embodiment, are arranged radially in the shape of a star.

Louvers 8 are molded onto or assigned to the slots 2 in the interior of the housing 1, which louvers are set in such a way that a very rapid and yet draft-free circulation of air in the room is achieved by a very good induction of an air flow led from the inside to the outside.

On the other side of the cover plate 3, the housing 1 is covered by a plate 5, of which edges 6 project laterally, partially overlapping the side walls 2. The plate 5 is permanently fastened by attachment elements 7, such as, for example, rivets or the like, which penetrate both the edges 6 and the side walls 2.

Recessed or worked into the side walls 2 of the housing 1 are circulating-air slots 9, behind which louvers 10 are arranged in an adjustable manner. The louvers 10 are set in such a way that the best possible desired inlet air can pass into the interior of the housing 1.

A refrigeration assembly 11 is inserted in the housing 1. The refrigeration assembly 11 essentially comprises a covering 12, a cooling unit 13 and two fans 14 and 15 assigned to the cooling unit 13.

The covering 12, which may be of square construction, for example, has side parts 16, from which side strips 17 project towards the cover plate 3. The covering 12 sits with these side strips 17 on the cover plate 3.

Towards the plate 5 of the housing 1, the covering 12 forms a shoulder 18 which forms a round opening 19. The opening 19 is surrounded by a cylindrically shaped air inlet 20, onto which a rim 21 is molded. Using this rim 21, the air inlet 20 is fastened to the shoulder 18 by attachment elements 22, such as, for example, rivets, screws or the like.

The cooling unit 13, which is situated inside the covering 12, essentially comprises pipes 23 which extend horizontally and vertically to one another and are connected together. Flat, approximately rectangular louvers 24 are mounted on these pipes 23 so that these louvers 24 preferably lie perpendicular to the cover plate 3.

These louvers 24 are arranged in very close succession and thus guarantee a very good temperature exchange by the formation of a large surface.

Figure 3:
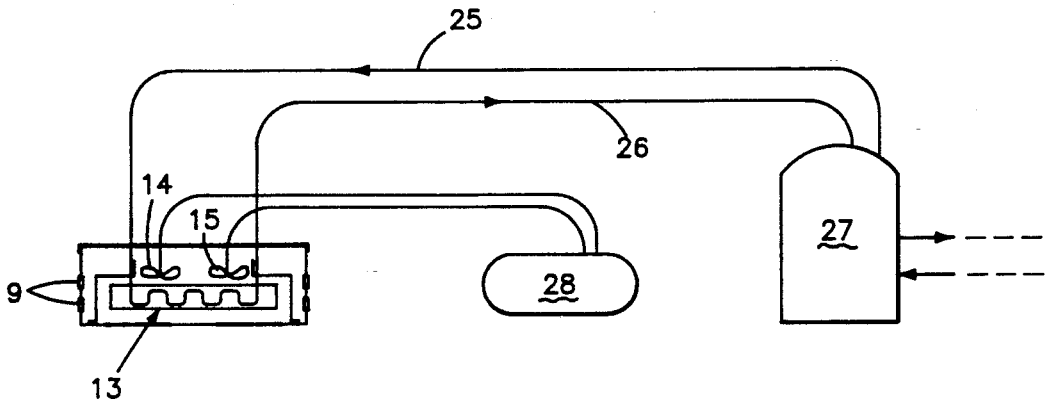
FIG. 3 shows a diagrammatic illustration of a circulation for operating the outlet according to FIG. 1.
Figure 4:
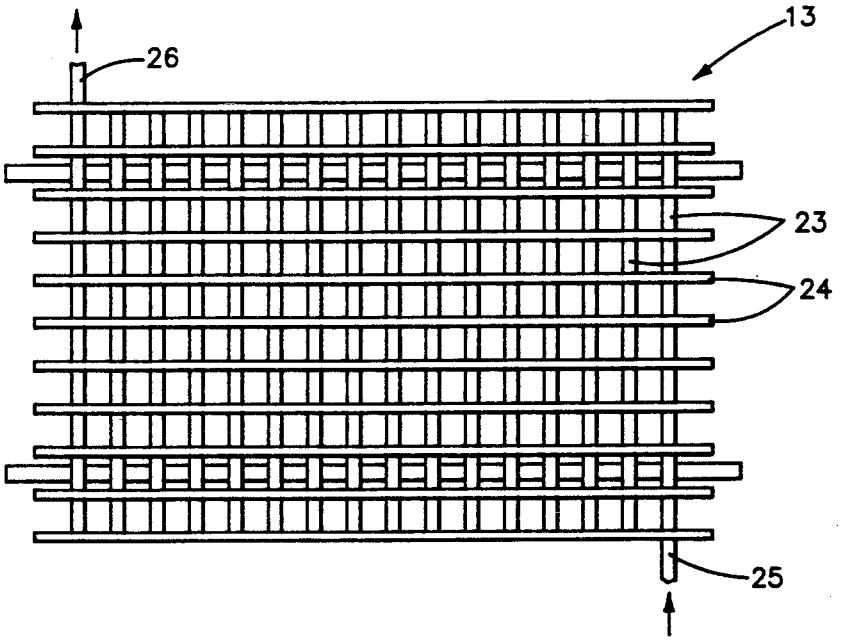
FIG. 4 shows a partial sectional view of the cooling unit employed in the device of the present invention.

According to FIG. 3, the pipes 23 have a connection (not illustrated in detail) to a supply line 25 and to a return line 26.

Installed inside the air inlet 20 are two fans 14 and 15 which can be connected separately. Due to their operation, the fans 14 and 15 cause air to flow through the circulating-air slots 9 into the housing 1 and from there into the air inlet 20. From here, the air is blown by the fans 14 and 15 over the pipes 23 due to the louvers 24, during which process a heat exchange takes place. In this case, the cooler temperature brought about by the water is transferred to the air flow and, at the same time, heat is given off to the water by the air flow. The water thus heated in the pipes 23 flows via the return line 26 into a heat pump 27. Here, heat is again withdrawn from the water, it cools down to approximately tap water temperature and flows back to the cooling unit via the approach line 25. The heat withdrawn by the heat pump can be used, for example, for heating parts of the building facing away from the sun or for the heating of service water.

The entire ventilation device R with the refrigeration assembly 11 is controlled via a room thermostat 28. In this case, the room thermostat 28 primarily governs the operation of the fans 14 and 15.

If an intensive cooling of the room is required, the room thermostat 28 switches both fans 14 and 15 to operation. In the case of only slight cooling, only one fan, for example fan 14, is switched to operation so that air is applied to only one half of the cooling unit 13.

If no cooling is required at all, the room thermostat 28 puts both fans 14 and 15 out of operation. In this case, the heat pump 27 is also switched off by the room thermostat 28.

We claim:

1. A device for introducing air into a room comprises: an external housing having longitudinally extending side wall means defining an interior space, said side wall means having slots provided with adjustable louvers for drawing air into said interior space; a cover plate mounted on said side wall means along a first plane substantially perpendicular to said longitudinally extending side wall means, said cover plate having outlet means for passing air from said interior space to said room; an internal hollow housing mounted within said external housing on said cover plate and defining with said external housing an annular space, said internal hollow housing defining first and second internal spaces arranged serially wherein said first space is larger than said second space and adjacent said cover plate; blower means located within said second space for drawing air through said slots, said annular space and said second space and forcing said air into said first space and out said outlet means; and refrigeration means located in said first space, said refrigeration means comprises first and second set of pipe means connected together wherein said first set of pipe means extend horizontally and lie in a second plane substantially parallel to said first plane and said second set of pipe means extend vertically and lie in a third plane substantially parallel to said first and second planes, a plurality of rectangular louvers secured to said pipes, said louvers lying in a fourth plane perpendicular to said first, second and third planes.

2. A device according to claim 1 wherein said refrigeration means is connected to a heat pump such that said first and second set of pipe means receive cold water from the heat pump and return heated water to the heat pump.

3. A device according to claim 1 wherein said blower means is controlled by means of a thermostat.

4. A device according to claim 3 wherein the heat pump is controlled by the thermostat.

5. A device according to claim 2 wherein said outlet means comprises a plurality of slots arranged radially in a star shaped configuration.

6. A device according to claim 5 wherein at least one louver is associated with each slot of said outlet means.

* * * * *